United States Patent [19]

Stier et al.

[11] 4,193,347

[45] Mar. 18, 1980

[54] CASELESS AMMUNITION

[75] Inventors: Otto Stier; Udo Vollmer, both of Biberach an der Riss, Fed. Rep. of Germany

[73] Assignee: Vollmer Werke, Maschinenfabrik GmbH, Biberach an der Riss, Fed. Rep. of Germany

[21] Appl. No.: 877,871

[22] Filed: Feb. 15, 1978

[51] Int. Cl.[2] ..... F42B 5/02; F42B 9/00

[52] U.S. Cl. ..... 102/38 CC; 42/88; 89/34

[58] Field of Search ..... 42/87–90; 102/38 R, 38 CC, 38 NR; 206/3; 89/34 R, 35 R

[56] References Cited

U.S. PATENT DOCUMENTS

| | | | |
|---|---|---|---|
| 580,176 | 4/1897 | Johnson | 42/88 |
| 3,153,500 | 10/1964 | Packmayr | 206/3 |
| 3,504,629 | 4/1970 | Mack, Jr. | 102/38 CC |
| 3,706,260 | 12/1972 | Rausing | 89/35 |
| 3,713,240 | 1/1973 | Goldin | 102/38 CC |
| 3,861,308 | 1/1975 | Grandy | 102/38 NC |
| 3,892,181 | 7/1975 | Goldin | 102/43 |
| 3,990,170 | 11/1976 | Griffs | 42/89 |

FOREIGN PATENT DOCUMENTS

| | | | |
|---|---|---|---|
| 1137350 | 9/1962 | Fed. Rep. of Germany | 42/88 |

*Primary Examiner*—Harold J. Tudor

*Attorney, Agent, or Firm*—Brooks, Haidt, Haffner & Delahunty

[57] ABSTRACT

Caseless cartridges including a bullet, charge, and detonator, have tongue and groove interfitting faces to form a stack, held in a magazine which can be clipped to another magazine.

2 Claims, 8 Drawing Figures

FIG. 1
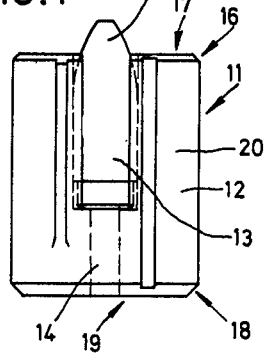
FIG. 3
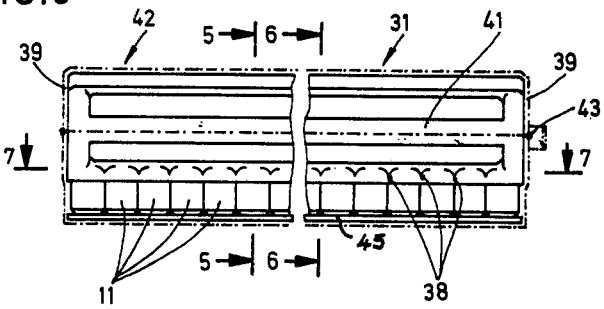
FIG. 2
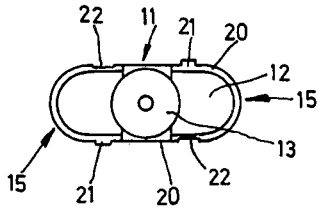
FIG. 4
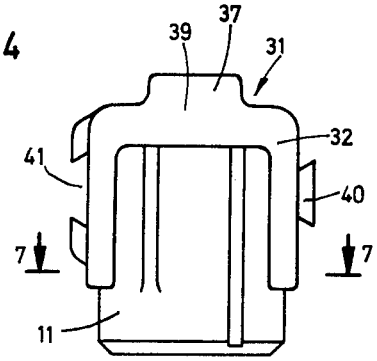
FIG. 5
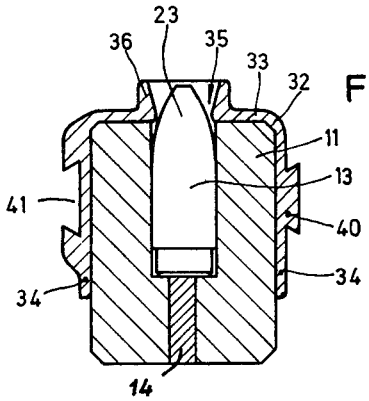
FIG. 6
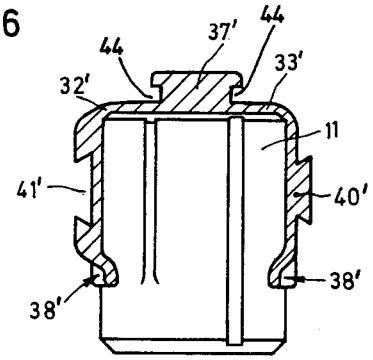
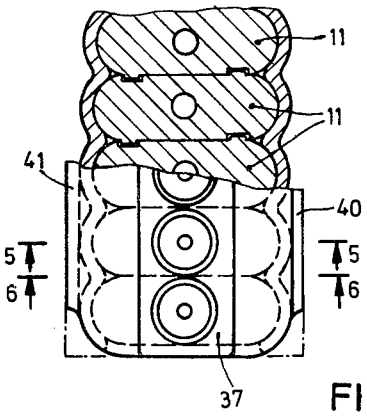
FIG. 7
FIG. 8
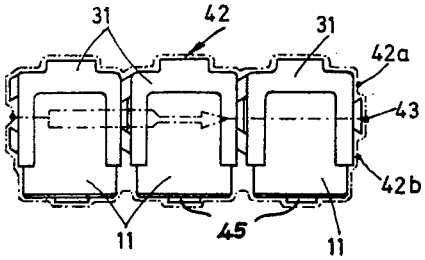

CASELESS AMMUNITION

This invention relates to caseless ammunition in the form of parallelepipedic cartridges comprising bullets, charges and detonators. The invention is also concerned with magazines which hold together a stack of such cartridges and retain them ready for use.

Particularly for small, military firearms, increasing importance is being attached to the search for a suitable caseless ammunition which provides considerable advantages compared with conventional ammunition and in particular brings about a reduction in weight.

The most varied proposals have already been made regarding the design of caseless cartridges. They are substantially based on the bullet being surrounded by a charge which consists of compressed explosive mixed with a binder. The shape of the caseless cartridges is largely determined by the weapon in which the ammunition is to be used.

The invention aims to provide a caseless cartridge which can be used in a modern small arm designed to receive a stack of cartridges held together in a magazine, the cartridges being fed individually into a cartridge chamber for firing purposes.

According to one aspect of the invention, a caseless cartridge comprises a bullet, a charge and a detonator, the cartridge having a width, between front and back faces thereof, substantially equal to the external diameter of the bullet, the front and back faces being interconnected by rounded side faces, and the cartridge also having end faces at least the curved edges of which are chamfered.

According to another aspect of the invention a caseless, generally parallelepipedic cartridge comprises a bullet, a charge and a detonator, wherein the size of the cartridge substantially corresponds to the calibre of the bullet and wherein the cartridge has narrower side faces which are rounded and end faces the edges of which are chamfered.

Such a configuration of the cartridge makes it possible to stack the cartridges in a space-saving manner, provides extremely favourable conditions for the design of the small arm and ensures reliable use in operation in the small arm. The rounded side faces in particular afford good guidance of the cartridges on ejection from the magazine, even if the cartridges are standing singly in the magazine, i.e. even if the adjacent cartridges have already been ejected from the magazine. As a result of the chamfers at the edges of the end faces reliable insertion into the cartridge chamber is ensured and undesirable crumbling of the edges of the charge is avoided.

Advantageously, corresponding guide grooves and tongues are located on the parallel, wider side faces of the cartridge in such a way that the tongues of one cartridge contained in the magazine stack engage in the groove of an adjacent cartridge, so that on discharging each cartridge from the magazine stack, the cartridge is reliably guided in order to reduce tilting to the minimum. Tilting could otherwise cause undesired operating problems in connection with the firearm.

As this ammunition is in particular intended for high speed firearms, the greatest importance is attached to the completely satisfactory feeding of the cartridges from the magazine to the firing position in the firearm. For reliable guidance, it is proposed that the nose of the bullet projects slightly beyond the end face of the charge, so that the nose can project into an opening in the magazine.

The magazine which is preferably used to store and deliver the caseless cartridges to the loading and feed mechanism of the small arm comprises a U-shaped cartridge clip which partially covers the upper ends and narrower side faces of the contiguously stacked cartridges, the magazine having side flanges projecting into the recess between the narrower rounded side faces of each two adjacent cartridges. The web of the cartridge clip may contain openings for the passage of the noses of the bullets of the cartridges, which openings are advantageously provided with a surrounding collar, whose inner surface may be widened upwardly in a funnel-shaped manner. As a result of this magazine design, the cartridges are individually guided and held and permit a correct, untilted ejection from the magazine with the aid of a plunger which is guided in the opening of the clip web surrounded by the collar.

FIGS. 1 to 8 of the accompanying drawings illustrate a preferred embodiment of the present invention.

In the drawings:

FIG. 1 is a side view of a caseless cartridge,

FIG. 2 is a plan view of the cartridge of FIG. 1, showing the end face thereof from which the bullet projects, FIG. 3 is a side view of a magazine containing caseless cartridges, FIG. 4 is an end view of the magazine of FIG. 3, FIG. 5 is a sectional view taken on the line 5—5 of FIG. 3, FIG. 6 is a sectional view taken on the line 6—6 of FIG. 3, FIG. 7 is a plan view of the magazine, partially in section on line 7—7, and FIG. 8 is an end view of three interconnected magazines, each according to FIGS. 3 to 7.

As can be gathered from FIGS. 1 and 2, the generally parallelepipedic caseless cartridge 11 comprises a charge 12 which forms the cartridge body and which surrounds the sides and bottom of the bullet 13, and a detonator 14 which can optionally be arranged in a different position in the charge from that shown. The narrower side faces 15 of the cartridge are rounded in a semi-cylindrical shape and the edge 16 of the upper end face 17 and the edge 18 of the lower end face 19 are chamfered. On the two parallel wider side faces 20 are provided tongues 21 and grooves 22 which are positioned in such a way that in the case of contiguously stacked cartridges 11, the tongues 21 of one cartridge 11 engage in the grooves 22 of the adjacent cartridge 11. The bullet 13 is fixed in the charge 12 in such a way that the bullet nose 23 projects slightly beyond the face 17 of the cartridge 11.

The magazine 31 (FIG. 3) which receives, stores and delivers the caseless cartridges 11, comprises a U-shaped cartridge clip 32 (FIGS. 4 and 5) whose central web 33 is positioned above the faces 17 of the cartridges 11 and whose side flanges 34 extend down the rounded narrow side faces 15 of the cartridges 11. Openings 35 surrounded by collars 36 are provided in the webs 33 at the locations of the noses 23 of the bullets. The noses 23 of the bullets 13 project through these openings 35 and are protected by the collars 36. Instead of having each individual opening surrounded by a collar, the web 33 can be provided with a continuous ledge 37 (FIG. 7) in which are disposed the openings 35 for the bullet noses 23; the openings 35 widen upwardly in funnel-shaped manner.

At least in the region of their lower edges, the flanges 34 of the clip 32 are provided with lips 38 which engage in the gusset-shaped recesses between the individual cartridges 11, so that the rounded side faces 15 of the cartridges 11 are substantially embraced by the co-operating shape of the lips 38, so that the flanges 34 reliably guide the cartridges on ejection from the magazine 31.

As can be gathered from FIG. 3 the magazine 31 is not closed at its end faces 39. The cartridges 11 located immediately behind the end faces 39 are partially covered at the lateral edges and at the upper edges of the cartridges 11 so that the U-shaped clip 32 can be moved away over a stop for the cartridges 11.

In order to permit a compact housing of the ammunition and the packaging of the magazines, dovetail tongues 40 and dovetail grooves 41 can be provided on the outsides of the flanges 34, so that several clips can be joined together at their flanges, as shown in FIG. 8.

Packed magazines filled with cartridges 11 can be packed in containers 42 made from vacuum formed plastics sheets in order to protect the caseless cartridges from moisture and dirt. Advantageously, such protective containers are made in two parts 42*a*, 42*b* which are interconnected by an adhesive tape at their joint. However, it is also possible to weld together the two parts and provide a tear-open strip 43 for opening purposes. Advantageously, two or three magazines are packed in one protective container.

Protective strips 45 made from solid material are provided on the bottom of the magazine container 42 to underly the detonators 14 in order to protect the latter against undesired external influences. In place of protective strips 45, the bottom of the container 42 can be constructed in such a way that the detonators 14 of the cartridges 11 are adequately protected by the actual container. Thus, it is for example possible to provide protective ribs or to corrugate the bottom of the container 42.

If in the magazine channel of the firearm, there is a guideway, the ribbed guide 37' on the web 33' of the cartridge clip 32' (FIG. 6) is profiled, for example given a dovetailed configuration or provided with lateral grooves 44 in which engage support bars on the side of the firearm. This leads to precise centring of the magazine wth respect to the loading plungers of the weapon and suspends the magazine at the end thereof which facilitates the discharge of cartridges 11 and the support of the clip 32'.

What we claim is:

1. A magazined ammunition stack for hand firearms for firing caseless ammunition, of the type in which caseless cartridges are delivered out of the magazined ammunition stack into the cartridge chambers of a cartridge holder, consisting of a number of consecutively arranged caseless cartridges in which a bullet is partly surrounded by a charge, and a strip-shaped magazine of elastic plastics material holding the stacked cartridges, having chambers for taking up the cartridges, wherein:

(a) each cartridge comprises a parallelepipedic shaped charge having mutually parallel wider side faces adapted to lie against side faces of adjacent cartridges, each cartridge having a guide groove and a guide tongue which correspond to each other in such a way that the tongue on the side face of one cartridge mates with a corresponding groove of an adjacent cartridge;

(b) the parallelepipedic shaped charge of each cartridge is provided with an approximately semi-cylindrical round end on its two opposite, parallel side faces;

(c) the parallelepipedic charge of each cartridge has a longitudinal axis recess for holding a bullet, said recess being of a size which corresponds to the calibre of the bullet;

(d) the parallelepipedic shaped charge of the cartridge has rounded off or chamfered outer edges on upper and lower end faces, running into said side faces;

(e) a plurality of contiguously stacked parallelepipedic cartridges have at their bullet ends more than half of their height covered by a U-shaped profiled magazine clip, free edges of which clip have flanges with lips projecting into a gusset formed between each two adjacent cartridges by the rounded edges of narrow side faces of the cartridge, webs of said clip having openings above the bullets for the through-projection of a loading ram which pushes the cartridge out of the magazine clip.

2. Magazined ammunition stack according to claim 1, wherein on the outer side of one flange of the magazine clip there is a dovetail groove and on the outer side of another opposite flange there is a dovetail tongue corresponding to said dovetail groove.

* * * * *

UNITED STATES PATENT AND TRADEMARK OFFICE

CERTIFICATE OF CORRECTION

PATENT NO. : 4,193,347

DATED : March 18, 1980

INVENTOR(S) : Otto Stier; Udo Vollmer

It is certified that error appears in the above-identified patent and that said Letters Patent are hereby corrected as shown below:

Column 4, line 26

"axis recess" should read --axial recess--.

Signed and Sealed this

*Nineteenth* Day of *August 1980*

[SEAL]

*Attest:*

SIDNEY A. DIAMOND

*Attesting Officer*

*Commissioner of Patents and Trademarks*